United States Patent [19]

Fukui

[11] Patent Number: 4,515,358

[45] Date of Patent: May 7, 1985

[54] SHEET FEEDING APPARATUS

[75] Inventor: Kazuyuki Fukui, Toyohashi, Japan

[73] Assignee: Minolta Camera Kabushiki Kaisha, Osaka, Japan

[21] Appl. No.: 447,770

[22] Filed: Dec. 8, 1982

[30] Foreign Application Priority Data

Dec. 21, 1981 [JP] Japan ..... 56-207697

[51] Int. Cl.[3] ..... B65H 3/52

[52] U.S. Cl. ..... 271/122

[58] Field of Search ..... 271/121, 122, 125

[56] References Cited

U.S. PATENT DOCUMENTS

| | | | |
|---|---|---|---|
| 1,066,027 | 7/1913 | Markoe | 271/122 |
| 3,021,136 | 2/1962 | Fox | 271/122 X |
| 3,754,754 | 8/1973 | Peterson | 271/122 |
| 3,833,214 | 9/1974 | Zawiski | 271/270 |
| 3,857,559 | 12/1974 | McInerny | 271/122 |
| 3,937,455 | 2/1976 | Hauser | 271/10 |
| 4,208,046 | 6/1980 | Shimizu | 271/122 |
| 4,212,456 | 7/1980 | Ruenzi | 271/121 X |

*Primary Examiner*—Richard A. Schacher

*Attorney, Agent, or Firm*—Watson, Cole, Grindle & Watson

[57] ABSTRACT

A sheet feeding apparatus comprising a first feed roller for feeding the uppermost sheet of a stack of sheets in contact therewith, a second feed roller positioned toward the sheet feeding direction from the first feed roller and rotatable in the feeding direction, a separating roller rotatable in the same direction as the second feed roller in contact therewith, and means for driving one of the second feed roller and the separating roller at opposite ends of its shaft and for pressing these rollers into contact with each other. The sheets are fed individually by being forwarded by the first feed roller and thereafter separated off singly at the nip of the second feed roller and the separating roller.

6 Claims, 12 Drawing Figures

SHEET FEEDING APPARATUS

BACKGROUND OF THE INVENTION

1. Technical Field

The present invention relates to a sheet feeding apparatus for use in copying machines, printing machines, etc. for feeding paper, and more particularly to such an apparatus for feeding stacked sheets one by one separately and reliably.

2. Prior Art

Such sheet feeding apparatus can be divided generally into two types according to the method of separating stacked sheets individually. One is the type wherein sheets are separated by pawls, and the other type employs rollers for separation. Although simple in construction, the former type is somewhat instable in its sheet separating performance and is not suited for feeding sheets at a high speed. The latter type comprises a pair of rollers movable on the front and rear sides of a sheet in opposite directions to separate the sheet off and is generally superior to the former pawl type in separation efficiency.

The apparatus of the roller type include those wherein the rollers are spaced apart by a clearance (U.S. Pat. No. 4,208,046), and those wherein the rollers are in pressing contact with each other (U.S. Pat. No. 3,937,455). The apparatus of the clearance type can separate sheets satisfactorily insofar as the clearance between the rollers can be held constant for the sheets, but they have the drawback of involving difficulty in maintaining a constant roller-to-roller clearance and being complex in construction. On the other hand, the apparatus of the contact type tend to exhibit somewhat instable sheet separating performance since the pair of rollers are driven each at only one side of the roller shaft. Moreover they have the drawback of being complex in construction since the two rollers are held in pressing contact and driven individually. Further although the apparatus of the contact type are capable of separating sheets generally satisfactorily if suitable pressing means is used for the contact between the rollers, they are unable to handle sheets of widely varying thicknesses. They have another drawback in that for example when the pressing means is impaired in performance, the resulting variations in the sheet separating force lead to an instable operation.

SUMMARY OF THE INVENTION

The present invention relates to a sheet feeding apparatus.

An object of the invention is to provide a sheet feeding apparatus of the roller contact type which is stabilized in sheet separating performance by a simple construction.

Another object of the invention is to provide a sheet feeding apparatus by which sheets of widely varying thicknesses can be separated and which exhibits stable separating performance over a prolonged period of time.

BRIEF DESCRIPTION OF THE DRAWINGS

Throughout the drawings, like parts are referred to by like reference numerals.

DESCRIPTION OF THE PREFERRED EMBODIMENTS

Figure 1:
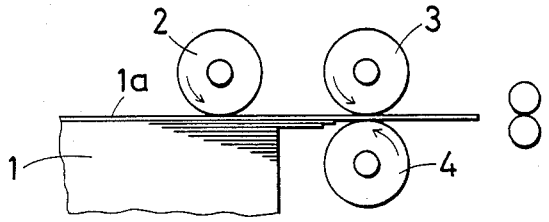
FIGS. 1 and 2 are a side elevation and a perspective view showing an embodiment of the invention.
Figure 2:
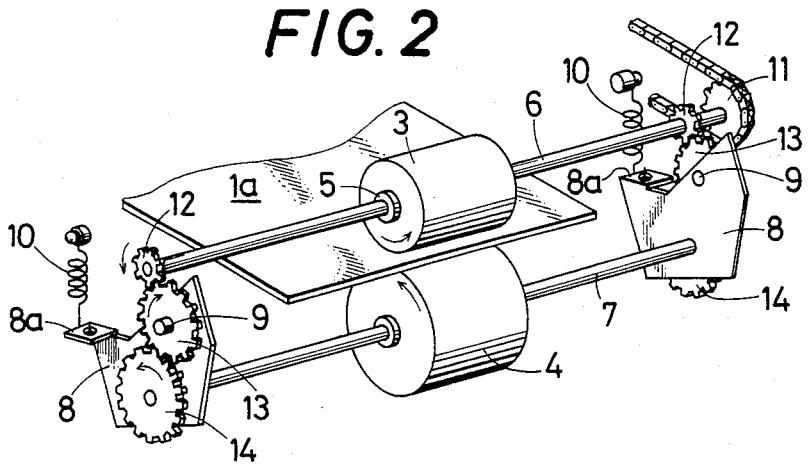

FIGS. 1 and 2 show a basic embodiment of the present invention. With reference to FIG. 1, the paper feeder of a copying machine or the like has sheets 1 stacked therein. The uppermost sheet 1*a* is delivered to a separating assembly comprising a second feed roller 3 and a separating roller 4 by a first feed roller 2 in contact with the sheet 1*a* for moving the sheet 1*a* in a feeding direction. The second feed roller 3 and the separating roller 4 rotate with the sheet 1*a* nipped therebetween from above and below. Since the second feed roller 3 rotates counterclockwise like the first feed roller 2, the second feed roller 3 exerts on the upper surface of the sheet 1*a* a force acting in the feeding direction. On the other hand, the separating roller 4 rotates in a direction opposite to the direction of rotation of the roller 3, exerting a reversely acting force on the lower surface of the sheet 1*a*. Consequently even if a plurality of sheets 1 are forwarded from the feeder, the uppermost sheet 1*a* only is separated from the underlying sheet or sheets and properly sent to the desired position.

With reference to FIG. 2, the second feed roller 3 is mounted on a second feed roller shaft 6 with a one-way clutch 5 provided therebetween. The shaft 6 is rotatably supported by an unillustrated main body frame at opposite ends of the shaft. The separating roller 4 is mounted on a separating roller shaft 7 which is rotatably supported at its opposite ends by opposed pivotal frames 8. Each pivotal frame 8 is movably supported by a pivot 9 fixed to the main body frame. The separating roller 4 is elastically pressed against the second feed roller 3 by springs 10 each acting on a lug 8*a* formed at one end of the frame 8 remote from the pivot 9. The output of an unillustrated electric motor is delivered to a sprocket wheel 11 fixed to one end of the shaft 6 to drive the second feed roller 3. The output is further transmitted from drive gears 12 mounted on opposite ends of the shaft 6 through intermediate gears 13 on the pivots 9 to driven gears 14 mounted on opposite ends of the shaft 7 to drive the separating roller 4. Although the separating roller 4 is thus adapted to receive power from opposite ends of the second feed roller shaft 6 through the gears in the above arrangement, the second feed roller 3 may be adapted to receive power from opposite ends of the separating roller shaft 7 through gears.

Usually the second feed roller 3 is made of EPDM rubber having a rubber hardness of 40° or neoprene rubber having a rubber hardness of 40° to 60°. The separating roller 4 is made of foamed urethane having an Asker C hardness of 40° to 80°, foamed polypropylene having an Asker C hardness of 40° to 60°, or the like. The drive gears 12 and the driven gears 14 are so designed that the ratio of the return speed $S_2$ of the separating roller 4 to the feeding speed $S_1$ of the second feed roller 3 will be in the range of 0.2 to 1.0 in accordance with the materials used for these rollers.

With the above arrangement, the separating roller 4 supported at its opposite ends by the pivotal frames 8 can be revolved about the pivots 9 and uniformly pressed into contact with the second feed roller 3 on the roller shaft 6 supported on the unillustrated frame, by being biased by the springs 10 which are set to a suitable value. Moreover since the separating roller 4 can be driven by the power transmitted to the driven gears 14 at its opposite sides from the drive gears 12 at opposite ends of the shaft 6 through the intermediate gears 13, sheets can be separated individually reliably at the location where the separating roller 4 is in contact with the second feed roller 3.

Figure 3:
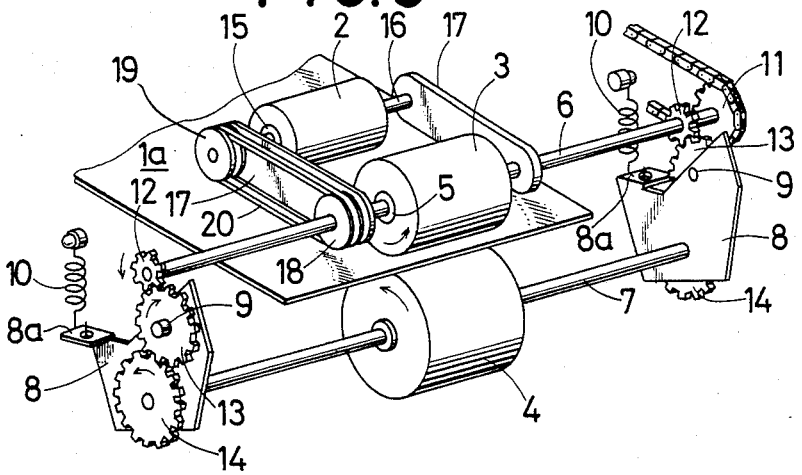
FIGS. 3 and 4 are perspective views showing modifications of the embodiment.

FIG. 3 shows a modification of the embodiment of FIG. 2. The first feed roller 2 of the foregoing embodiment is mounted on a first feed roller shaft 16 with a one-way clutch 15 provided therebetween. Opposite ends of the roller shaft 16 are supported by arm frames 17 rotatably mounted on the second roller shaft 6. The first feed roller 2 is adapted to be driven by the shaft 6 through belts 20 reeved around pulleys 18, 19 fixedly mounted on the second and first feed roller shafts 6, 16.

When the sheet feeding apparatus has the above construction, the first and second feed rollers 2, 3 can be maintained at the same surface speed at all times by a simple arrangement to achieve the same result as already described in respect to the foregoing embodiment, without necessitating an additional motor for driving the first feed roller 2.

Figure 4:
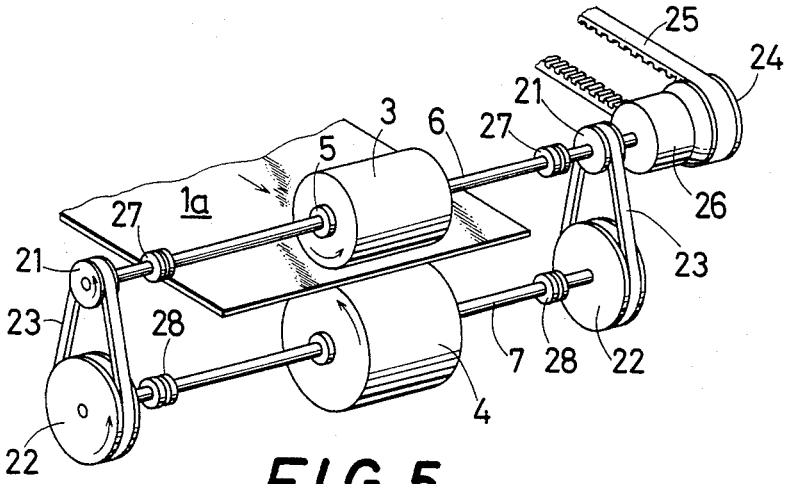

FIG. 4 shows another modification of the basic embodiment. Power is transmitted from opposite ends of the second feed roller 6 to the separating roller shaft 7 by pairs of pulleys 21, 22 fixed to opposite ends of the roller shafts 6, 7 and elastic belts 23 reeved around these pulleys 21, 22, in place of the trains of gears 12, 13, 14 used in the basic embodiment. Further the separating roller 4 is pressed into contact with the second feed roller 3 by the elastic belts 23 in place of the pivotal frames 8 and the springs 10 used in the above embodiment.

The present modification further has a pulley 24 instead of the sprocket wheel 11 of FIG. 2. Drive power is delivered from an input belt 25 through a clutch 26 provided between one of the pulleys 21 and the pulley 24 to the second feed roller shaft 6 supported by bearings 27. Moreover the separating roller shaft 7 is slightly movable with bearings 28 supporting opposite ends thereof toward the second feed roller 3 by the pressing force exerted by the elastic belts 23. The above arrangement may also be so modified that the drive power is transmitted from the separating roller shaft 7 to the second feed roller shaft 6.

With the sheet feeding apparatus of FIG. 4 described, the ratio of the return speed $S_2$ of the separating roller 4 to the feeding speed $S_1$ of the second feed roller 3 is variable more easily than is the case with the first embodiment by replacing the pulleys 21 and/or 22 and the elastic belts 23. This gives greater freedom to the operating condition in achieving the same result as attained by the first embodiment.

Figure 5:
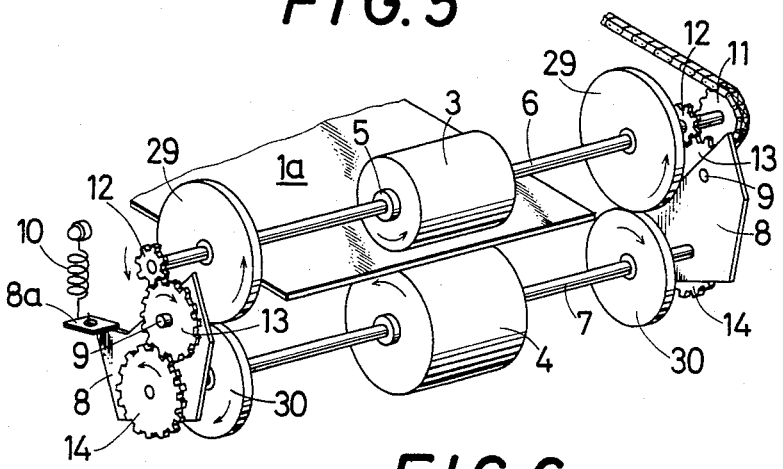
FIG. 5 is a perspective view showing another modification.

FIG. 5 shows another modification wherein in addition to the basic arrangement shown in FIG. 2, contact pressure regulating disks 29, 30 slightly smaller in combined diameter than the second feed roller 3 and the separating roller 4 are mounted on opposite ends of the second feed roller shaft 6 and the separating roller shaft 4, the disks on at least one of the roller shafts being freely rotatable in a direction opposite to those on the other shaft, whereby the contact pressure of the separating roller 4 exerted by the springs 10 is made controllable.

Figure 6:
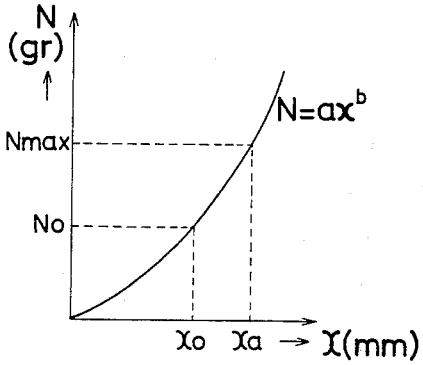
FIG. 6 is a diagram showing the contact pressure characteristics of a separating assembly.

In this case, the contact pressure N acting at the nip of the second feed roller 3 and the separating roller 4 is expressed by the following equation, which is represented by the exponential curve of FIG. 6.

$$N=ax^b$$

wherein x is the total amount of deformation of the second feed roller and the separating roller, and a and b are intrinsic constants determined by the combination of the second feed roller and the separating roller.

Accordingly when the second feed roller 3 has a radius $R_1$, the separating roller 4 has a radius $R_2$, the initial axis-to-axis distance between the two rollers 3, 4 is $l_0$, and $R_1+R_2-l_0=x_0$, the initial contact pressure $N_0$ acting a the nip of the rollers 3, 4 is given by $$N_0=ab_0^b.$$

Further assuming that the pressure regulating disks 29, 30 have radii of $R_1'$, $R_2'$ respectively and $(R_1+R_2)-(R_1'+R_2')=x_a$, the maximum contact pressure $N_{max}$ acting at the nip of the second feed roller 3 and the separating roller 4 when the disks 29, 30 are just in contact with each other is expressed by $$N_{max}=ax_a^b.$$

It therefore follows that when the sheet feeding apparatus is thus constructed, the contact pressure of the separating roller 4 pressed against the second feed roller 3 by the springs 10 through the pivotal frames 8 does not exceed the maximum contact pressure $N_{max}$ exerted when the regulating disks 29 and 30 are in contact. Accordingly the sheet 1*a* can be fed stably as separated off without interrupting the rotation of the two rollers 3, 4 if the regulating disks 29, 30 are so dimensioned that the contact pressure $N_{max}$ will not exceed the torque for driving the second feed roller 3 or the separating roller 4 and that the sheet transport force, as well as the separating force, will not vary greatly due to the increased repellent force resulting from an increase in the contact pressure.

With the embodiments of FIGS. 2 and 3, the contact pressure of the separating roller 4 to be given by the springs 10 must be maintained at a proper value lower than a specified value, whereas this arrangement is operable with greater freedom without such a limitation because the maximum contact pressure $N_{max}$ is regulated by the disks 29, 30. Furthermore, the contact pressure at the separating portion is finely adjustable by varying the outside diameters of the regulating disks 29, 30. Consequently a suitable contact pressure can be given to the separating roller in accordance with the thickness of the sheet 1*a* for handling sheets of varying thicknesses.

Figure 7:
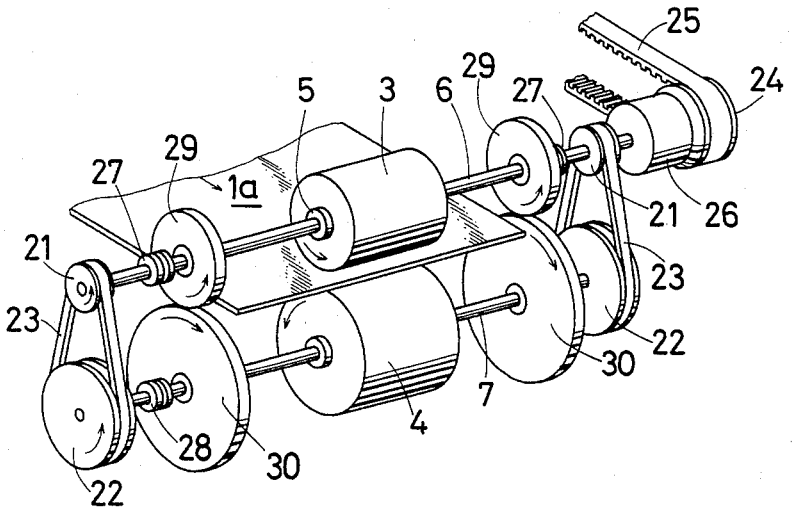
FIGS. 7 and 8 are a perspective view and a fragmentary side elevation showing other modifications.

FIG. 7 shows a modification of the embodiment of FIG. 5. In addition to the arrangement shown in FIG. 4, contact pressure regulating disks 29, 30 are mounted on opposite ends of the second feed roller shaft 6 and the separating roller 4 and positioned inwardly of the pulleys 21, 22, at least one of the disks 29, 30 being freely rotatable in a direction opposite to the other disk, whereby the contact pressure of the separating roller 4 given by the elastic belts 23 is made controllable.

With the sheet feeding apparatus of this construction, the separating roller 4 can be driven and pressed against the second feed roller 3 by the elastic belts 23 free of the drawback that the contact pressure, if excessively increased, will cause trouble to the separation and transport of the sheet 1*a*, permitting the apparatus to achieve exactly the same result as produced by the embodiment of FIG. 5.

Figure 8:
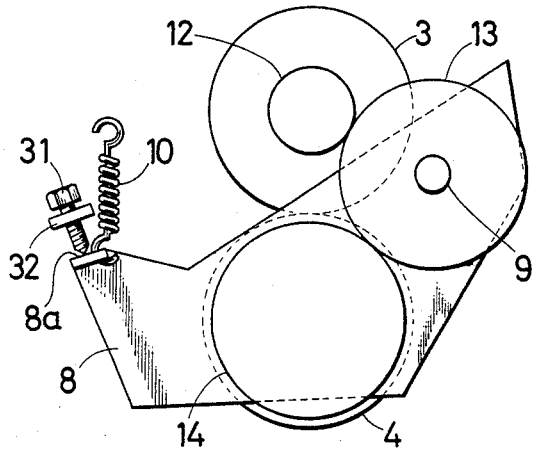

FIG. 8 shows another modification of the apparatus of FIG. 5. Instead of the disks 29, 30 shown in FIG. 5 for use as contact pressure regulating means, a contact pressure adjusting screw 31 adapted to contact the lug 8*a* of the pivotal frame 8 for restraining the pivotal frame 8 from being rotated about the pivot 9 by the spring 10 is screwed through a member 32 fixed to the unillustrated main body frame.

With the sheet feeding apparatus of this construction, the contact pressure of the separating roller 4 pressed against the second feed roller 3 by the springs 10 is maintained at a constant value when the lugs 8*a* of the pivotal frames 8 are positioned in bearing contact with the forward ends of the adjusting screws 31, so that sheets can be fed stably with the sheet transport and separating forces of the separating assembly adjusted most suitably in accordance with the thickness of the sheet 1*a*.

Figure 9:
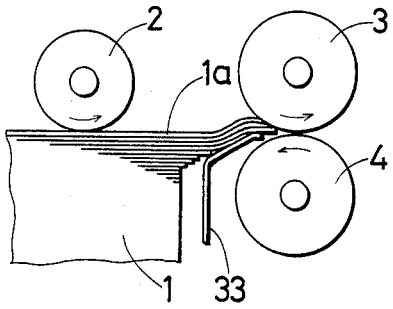
FIGS. 9 and 10 are diagrams illustrating different drawbacks of conventional fixed guides.
Figure 10:
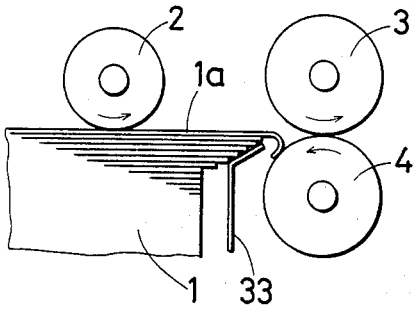

Each of the foregoing embodiments has a guide positioned on one side of the sheet separating assembly closer to the first feed roller 2. Heretofore used as such is a fixed metal guide 33 having an upper end bent obliquely upward toward the nip of the second feed roller 3 and the separating roller 4. If the forward end of the fixed guide 33 is slightly longer, the leading ends of sheets 1 forwarded in superposed layers engage in the space between the second feed roller 3 and the fixed guide 33 as seen in FIG. 9, causing a paper jam, whereas if the end of the guide 33 is slightly shorter, the leading end of the forwarded sheet 1*a* is likely to engage with the separating roller 4 as illustrated in FIG. 10 to cause a trouble.

Figure 11:
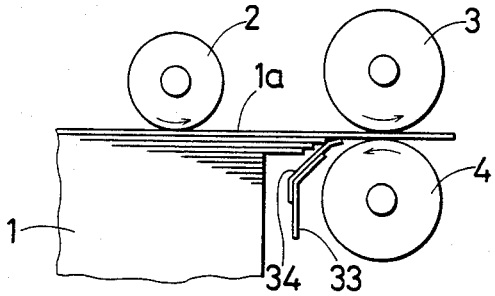
FIG. 11 is a side elevation showing a guide embodying the invention.

However, this drawback can be eliminated by cutting the forward end of the fixed metal guide 33 short to position the extremity a distance away from the nip of the two rollers 3, 4 and providing an elastic guide (Mylar or like polyester film) 34 over the entire surface of the bent portion of the guide 33 or only partly thereover as opposed to the separating roller 4 as shown in FIG. 11.

When the sheet 1*a* is fed singly in this case, the elastic guide 34 is depressed by the sheet 1*a* and properly guides the sheet 1*a* to the nip of the rollers 3, 4. If more than one sheet 1 is fed at a time, the sheet or sheets 1 other than the uppermost sheet 1*a* come into contact with the slanting surface of the elastic guide 34 and will not be sent to the nip of the two rollers 3, 4. Even if they are forwarded to the nip point, the elastic guide 34 is subjected to a repellent action toward the return direction by the separating roller 4, consequently preventing further double feeding of sheets.

Next, the separating action and transport force of the second feed roller 3 and the separating roller 4 will be described below with reference to experimental results. The experiments to be described below show that the speed ratio of the two rollers, $S_2/S_1$, should preferably be 0.2 to 1.0, more preferably 0.5 to 1.0.

Figure 12:
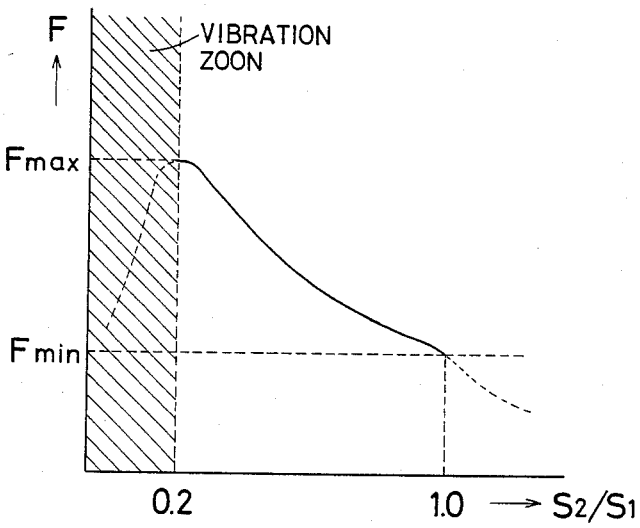
FIG. 12 is a diagram showing the transport force characteristics of an exemplary separating assembly.

The apparatus shown in FIG. 2 was used for the experiments. EPDM rubber having a rubber hardness of 40° was used for the second feed roller, and foamed urethane having an Asker C hardness of 40° (as determined by Hardness Tester Model C2, product of Kohbunshi Keiki Mfg. Co., the same as hereinafter) for the separating roller. When the second feed roller was driven in the sheet feeding direction at a surface speed $S_1$ of 300 mm/min, the second feed roller and the separating roller vibrated, failing to separate sheets with stability, if the surface speed $S_2$ of the separating roller driven in the sheet returning direction was lower than 60 mm/min, that is, $S_2/S_1<0.2$ (see FIG. 12). Further when $S_2$ exceeded $S_1$ ($S_2/S_1>1.0$), the transport force F became smaller than the minimum transport force $F_{min}$ needed for feeding sheets, failing to feed sheets smoothly although the separating force increased. These results indicate that the ratio of the speed of the separating roller to that of the second roller, $S_2/S_1$, should be 0.2 to 1.0 to obtain a transport force ($F_{min}$ to $F_{max}$) required for feeding sheets stably with proper separation.

The above experiment was repeated under the same conditions except that foamed urethane having an Asker C hardness of 80° was used for the separating roller. Sheets were fed stably with proper separation without the vibration of the second feed roller and the separating roller when the $S_2/S_1$ ratio was 0.5 to 1.0.

Although the above experiments were conducted with use of EPDM rubber of rubber hardness of 40° for the second feed roller, results comparable to those desribed above were achieved also when neoprene rubber having a rubber hardness of 40° to 60° was used for the second feed roller and foamed polypropylene having an Asker C hardness of 40° to 60° for the separating roller.

ADVANTAGES

Briefly, the sheet feeding apparatus of the present invention comprises a prefeed member (a first feed roller) for feeding the uppermost sheet of a stack of sheets in contact therewith, a feed roller (a second feed roller) positioned toward the sheet feeding direction from the prefeed member and rotatable in the feeding direction, a separating roller rotatable in the same direction as the feed roller in contact therewith, and means for driving one of the feed roller and the separating roller at opposite ends of its shaft and for pressing these rollers into contact with each other. Accordingly, sheets can be fed individually with reliability and stability by a simple arrangement by being given a separating force and a transport force uniformly at the nip of the feed roller and the separating roller.

The embodiments of FIGS. 5 and 8 include, in addition to the construction of the embodiment of FIG. 2, means for regulating the contact pressure between the second feed roller and the separating roller, so that the maximum contact pressure at the nip of these rollers can be regulated, while the contact pressure is finely adjustable in accordance with the thickness of sheets. In addition to the above advantage, therefore, sheets of widely varying thicknesses can be fed with sustained stability.

What is claimed is:

1. A sheet feeding apparatus for feeding stacked sheets one by one, comprising:

a prefeed member adapted to act on the uppermost sheet of the stack for feeding the sheet, a feed roller rotatable in the sheet feeding direction and mounted on a shaft, a separating roller rotatable in a sheet returning direction and mounted on a shaft, means for transmitting drive power from opposite ends of the shaft of one of the rollers to opposite ends of the shaft of the other roller, the drive power being delivered to the shaft of said one roller from a drive source, means for pressing the feed roller and the separating roller into contact with each other, and disks mounted on the shafts of the two rollers respectively and positionable in contact with each other at their peripheries, the disks being slightly smaller in combined diameter than the rollers, for regulating the contact with each other by the pressing means to a level not higher than a specified value.

2. A sheet feeding apparatus as defined in claim 1, wherein the drive power transmitting means includes a first gear mounted on each end of the shaft of said one roller, frames for pivotably holding the shaft of said other roller, a second gear disposed on each of the frames and mounted on each end of the shaft of said other roller, and at least one gear supported on each of the frames for coupling the first gear to the second gear, and the pressing means comprises springs biasing the frames in a direction to press the rollers into contact with each other.

3. A sheet feeding apparatus as defined in claim 1, wherein pulleys are mounted on the shafts of the two rollers each at each end of the shafts, and elastic belts are reeved around the pulleys to perform the two functions of transmitting the drive power from shaft to shaft at their opposite ends and pressing the two rollers into contact with each other.

4. A sheet feeding apparatus as defined in claim 1, wherein the feed roller comprises EPDM rubber having a rubber hardness of 40° or neoprene rubber having a rubber hardness of 40° to 60°.

5. A sheet feeding apparatus as defined in claim 1, wherein the separating roller comprises foamed urethane having an Asker C hardness of 40° to 80° or foamed polypropylene having an Asker C hardness of 40° to 60°.

6. A sheet feeding apparatus as defined in claim 1, wherein the ratio of the surface speed of the separating roller to the surface speed of the feed roller is in the range of 0.2 to 1.0.

* * * * *